United States Patent [19]

Johnson et al.

[11] 4,149,502

[45] Apr. 17, 1979

[54] INTERNAL COMBUSTION ENGINE CLOSED LOOP FUEL CONTROL SYSTEM

[75] Inventors: Michael L. Johnson; Gene A. West, both of Kokomo, Ind.

[73] Assignee: General Motors Corporation, Detroit, Mich.

[21] Appl. No.: 831,617

[22] Filed: Sep. 8, 1977

[51] Int. Cl.[2] ..... F02M 25/06

[52] U.S. Cl. ..... 123/119 EC; 123/119 R; 60/276

[58] Field of Search ..... 123/119 EC, 119 R, 119 DB; 60/276, 28 J

[56] References Cited

U.S. PATENT DOCUMENTS

| | | | |
|---|---|---|---|
| 3,939,654 | 2/1976 | Creps | 123/119 EC |
| 4,000,614 | 1/1977 | Abthoff et al. | 123/119 DB |
| 4,026,256 | 5/1977 | Fenn | 123/119 EC |

*Primary Examiner*—Charles J. Myhre

*Assistant Examiner*—Raymond A. Nelli

*Attorney, Agent, or Firm*—Howard N. Conkey

[57] ABSTRACT

A closed loop fuel control system is described for an internal combustion engine having two cylinder banks and an air/fuel mixture supply means for supplying a combustible mixture to each of the cylinder banks with the air/fuel ratio of the mixture supplied to each of the cylinder banks having relative values determined by the characteristics of the engine and the mixture supply means. Two exhaust gas sensors are provided, each being located at the exhaust discharge point of a respective one of the cylinder banks and sensing the oxidizing/reducing conditions of the exhaust gases from the respective cylinder bank. A controller adjusts the air/fuel mixture supply means to obtain a specified air/fuel ratio in response to combinations of exhaust gas oxidizing/reducing conditions as sensed by the exhaust gas sensors.

3 Claims, 3 Drawing Figures

INTERNAL COMBUSTION ENGINE CLOSED LOOP FUEL CONTROL SYSTEM

This invention relates to a closed loop fuel control system for an internal combustion engine.

Numerous closed loop fuel control systems are known for controlling the air/fuel ratio of a mixture supplied to an internal combustion engine to a predetermined value (usually stoichiometry) in response to a sensed gas constituent, such as oxygen, in the exhaust gases of the internal combustion engine. These systems are generally used with a catalytic converter of the three-way type which, when the air/fuel ratio is within a narrow band at stoichiometry, is effective to oxidize CO and HC and reduce $NO_X$ and generally utilize a single exhaust gas sensor located at the output of the exhaust gas manifold in a single manifold system or at the output of one of the exhaust gas manifolds in an engine having two cylinder banks and two corresponding exhaust manifolds. The sensor is located in close proximity to the exhaust outlet of the exhaust manifold for reasons including the improvement of the response time of the sensor and the decreasing of the warm-up time of the sensor, the exhaust gas being at its highest temperature at the manifold discharge point. When an exhaust gas sensor is used in an engine having two cylinder banks, it is assumed that the exhaust gas composition as sensed by the sensor at one of the manifold discharge points is representative of the exhaust gas composition from the other of the exhaust manifolds. However, as a result of the characteristics of the engine and the mixture supply means, the air/fuel ratio of the mixture supplied to each of the banks may be offset from one another so that the control of the air/fuel ratio to a predetermined value, such as stoichiometry, in response to a sensed gas constituent from the exhaust outlet of one of the manifolds results in the supplying of an air/fuel mixture to the cylinder bank associated with the other exhaust manifold offset from the desired air/fuel ratio. This result may occur, for example, where the air/fuel delivery means for the two cylinder bank are substantially independent such as in a two barreled carburetor system in which each of the barrels supplies fuel to a respective cylinder bank of the engine and wherein the supply characteristics of each half of the carburetor differ.

It is the general object of this invention to provide an improved closed loop fuel controller for controlling the air/fuel ratio of the mixture supplied to an internal combustion engine having two cylinder banks and where the air/fuel mixture supplied to each of the banks may have different values.

It is another object of this invention to provide an improved closed loop fuel control system for controlling the air/fuel ratio of the mixture supplied to an internal combustion engine having two cylinder banks which employs two exhaust gas sensors, each sensing the exhaust output of a respective one of the cylinder banks.

It is a more specific object of this invention to provide a closed loop fuel control system for an internal combustion engine having a pair of cylinder banks for controlling the air/fuel ratio of the mixture supplied to the cylinder banks in response to specific combinations of outputs of a pair of exhaust gas sensors each sensing the exhaust gas output of a respective one of the cylinder banks.

These and other objects of this invention may be best understood by the following description of the preferred embodiment of the invention and the drawings in which.

Figure 1:
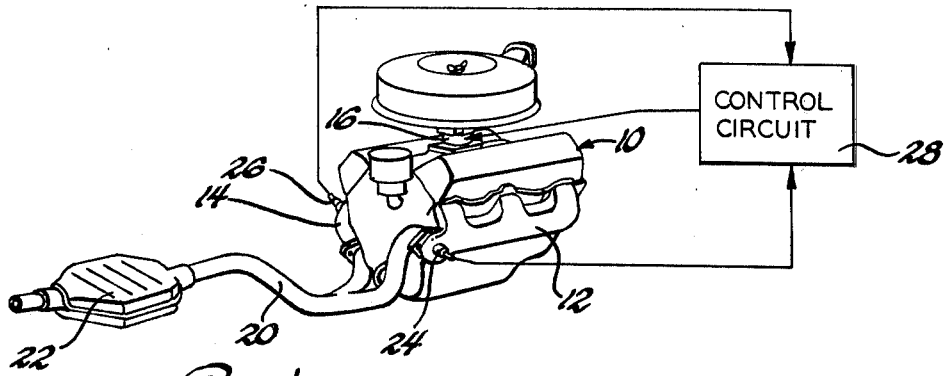
FIG. 1 is a view of an engine with its exhaust system and a general control system employing the principles of this invention for controlling the air/fuel mixture supplied to the engine.

Referring to FIG. 1, an internal combustion engine 10 is of the type having two cylinder banks each having respective exhaust manifolds 12 and 14. A mixture of fuel and air is supplied to each of the cylinder banks of the engine 10 by appropriate air/fuel supply means. In the preferred embodiment, the supply means includes a carburetor 16 which supplies fuel and air to the engine 10. However, it is understood that the supply means could employ other known apparatus for delivering an air/fuel mixture to the engine 10. The carburetor 16 may, for example, have two throttle bores having respective throttle blades which are controlled by the vehicle operator for controlling the air and fuel mixture supplied to each of the cylinder banks, and wherein each throttle and blade combination is associated with the delivery of an air/fuel mixture to a respective one of the cylinder banks of the engine 10.

The air/fuel mixture supplied to the engine 10, forms a combustible mixture drawn into the respective cylinders of the engine 10 and burned, thereby producing energy for driving, for example, an automobile. The combustion byproducts from each of the cylinder banks flow into the respective exhaust manifolds 12 and 14 and thereafter into a common exhaust conduit 20. The exhaust gases then flow through a catalytic converter 22 and are thereafter discharged into the atmosphere.

The catalytic converter 22 is of the three-way type wherein carbon monoxide, hydrocarbons and nitrogen oxide can be simultaneously converted if the air/fuel mixture supplied thereto is maintained within a narrow range at stoichiometry, the ratio containing fuel and oxygen in such proportions that, in perfect combustion, both would be completely consumed. If the air/fuel ratio deviates from stoichiometry, the converter conversion efficiency of at least one of the undesirable exhaust constituents decreases.

While in some instances it may be desired to operate the engine 10 at an air/fuel ratio different from stoichiometry, to provide for a maximum conversion of all three of the aforementioned exhaust gas constituents, the air/fuel ratio of the mixture provided by the air/fuel supply means (the carburetor 16, in the preferred embodiment) must be maintained substantially at stoichiometry. In the preferred embodiment, it will be assumed that stoichiometric control is desired.

The carburetor 16 is generally calibrated so as to supply an air/fuel mixture to each of the two cylinder banks of the engine 10 at stoichiometry. However, it is difficult to provide an air/fuel delivery means, such as the carburetor 16, which has the desired response over the full range of engine operating conditions. Additionally, these systems are generally incapable of compensating for various ambient conditions and fuel variations. Consequently the air/fuel ratio provided by the carburetor 16 in response to its fuel determining input parameters may deviate from stoichiometry during engine operation. Therefore, to provide for adjustment of the air/fuel ratio of the mixture supplied by the carburetor 16 to the engine 10 so as to obtain the desired converter conversion characteristics, a constituent of the exhaust gases from the engine 10 is sensed which is representative of the air/fuel ratio of the mixture supplied by the carburetor 16. The carburetor 16 is adjusted in accordance with the sensed exhaust gas constituent so as to provide an air/fuel ratio at the desired value which, in the preferred embodiment, is stoichiometry.

Conventionally, a single exhaust gas sensor is employed whose output is representative of the air/fuel ratio of the mixture supplied to the engine 10. Usually, this sensor is positioned in close proximity to the exhaust discharge of one of the manifolds 12 or 14 and its output is assumed to be representative of the air/fuel ratio of the mixture supplied to each of the cylinder banks of the engine 10. If the ratio of the air and fuel mixture supplied to each of the cylinder banks of the engine 10 are the same, the adjustment of the mixture supplied to each of the cylinder banks of the engine 10 in response to the composition of the gas discharge from one of the cylinder banks is effective to provide a stoichiometric air/fuel mixture to each of the cylinder banks. However, if, as a result of the fuel supply means and engine characteristics, the air/fuel ratio supplied to one of the cylinder banks varies from the ratio of the mixture supplied to the other one of the cylinder banks, the adjustment of the carburetor 16 in response to a single exhaust gas sensor responsive to the exhaust gases from one of the exhaust manifolds is effective to control the air/fuel ratio of the mixture supplied to one of the cylinder banks to the desired value but controls the air/fuel ratio of the mixture supplied to the other one of the cylinder banks to a value offset from stoichiometry. For example, in the present embodiment, the carburetor 16 includes essentially two separate fuel delivery means in that the mixture supplied through each bore is delivered to a respective one of the cylinder banks of the engine 10. The ratio of the air and fuel mixture supplied through each bore may vary from one another as a result of, for example, manufacturing tolerances. Consequently, the adjustment of the carburetor 16 in response to the sensing of the exhaust gases from one of the exhaust manifolds 12 or 14 may result in the ratio of the mixture supplied to one of the cylinder banks being controlled to stoichiometry and the ratio of the mixture supplied to the other one of the cylinder banks being offset from stoichiometry by an amount equal to the difference between the ratios of the mixtures supplied to the cylinder banks.

To provide for control of the carburetor 16 so as to maintain a substantially stoichiometric air/fuel ratio of the mixture supplied to both of the cylinder banks of the engine 10 while yet retaining the benefits of sensing the exhaust gases in close proximity to the exhaust discharge from the exhaust manifolds 12 and 14, the control system of this invention employs the use of two exhaust gas sensors 24 and 26 sensing the exhaust discharge from the exhaust manifolds 12 and 14 respectively. These sensors 24 and 26 are preferably of the zirconia type which, when exposed to engine exhaust gases at high temperatures, e.g., 700° F., generates an output voltage which changes abruptly as the air/fuel ratio of the exhaust gases pass through the stoichiometric air/fuel ratio. Such sensors are well known in the art, a typical example being that shown in U.S. Pat. No. 3,844,920 to Burgett et al, dated Oct. 29, 1974.

Figure 2:
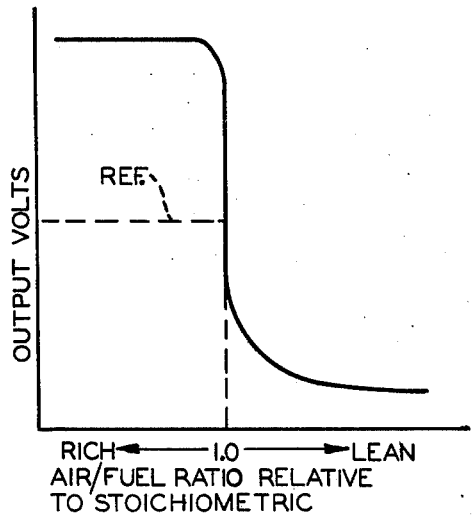
FIG. 2 is a graph illustrating a typical output signal of the air/fuel ratio sensors of FIG. 1.

FIG. 2 illustrates a typical output voltage of the sensors 24 and 26 as a function of the air/fuel ratio supplied by the carburetor 16. It can be seen that the voltage output of the respective sensors achieves its highest output level with rich air/fuel mixtures and its lowest level when the sensor is exposed to lean air/fuel mixtures. Further, it can be seen that the output voltage from the oxygen sensors exhibit an abrupt change between the high and low voltage values as the air/fuel ratio of the mixture passes through the stoichiometric air/fuel ratio.

The output voltages of the sensors 24 and 26, representative of the air/fuel ratio of the mixture supplied to the respective cylinder banks of the engine 10, are supplied to a control circuit 28 which is responsive to predetermined combinations of the outputs of the sensors 24 and 26 relative to the desired air/fuel ratio to adjust the carburetor 16 so that the mean value between the air/fuel ratios of the mixtures supplied to each of the cylinder banks is equal to the desired ratio which, in the preferred embodiment, is stoichiometry.

To provide for the adjustment of the carburetor 16 in accordance with the control circuit 28, the carburetor 16 includes an air/fuel ratio adjustment device, such as illustrated in the application Ser. No. 801,061 filed on May 27, 1977, and assigned to the assignee of the present invention, that is responsive to the control signal output of the control circuit 28 to adjust the air/fuel ratio of the mixture supplied to the cylinder banks of the engine 10.

Figure 3:
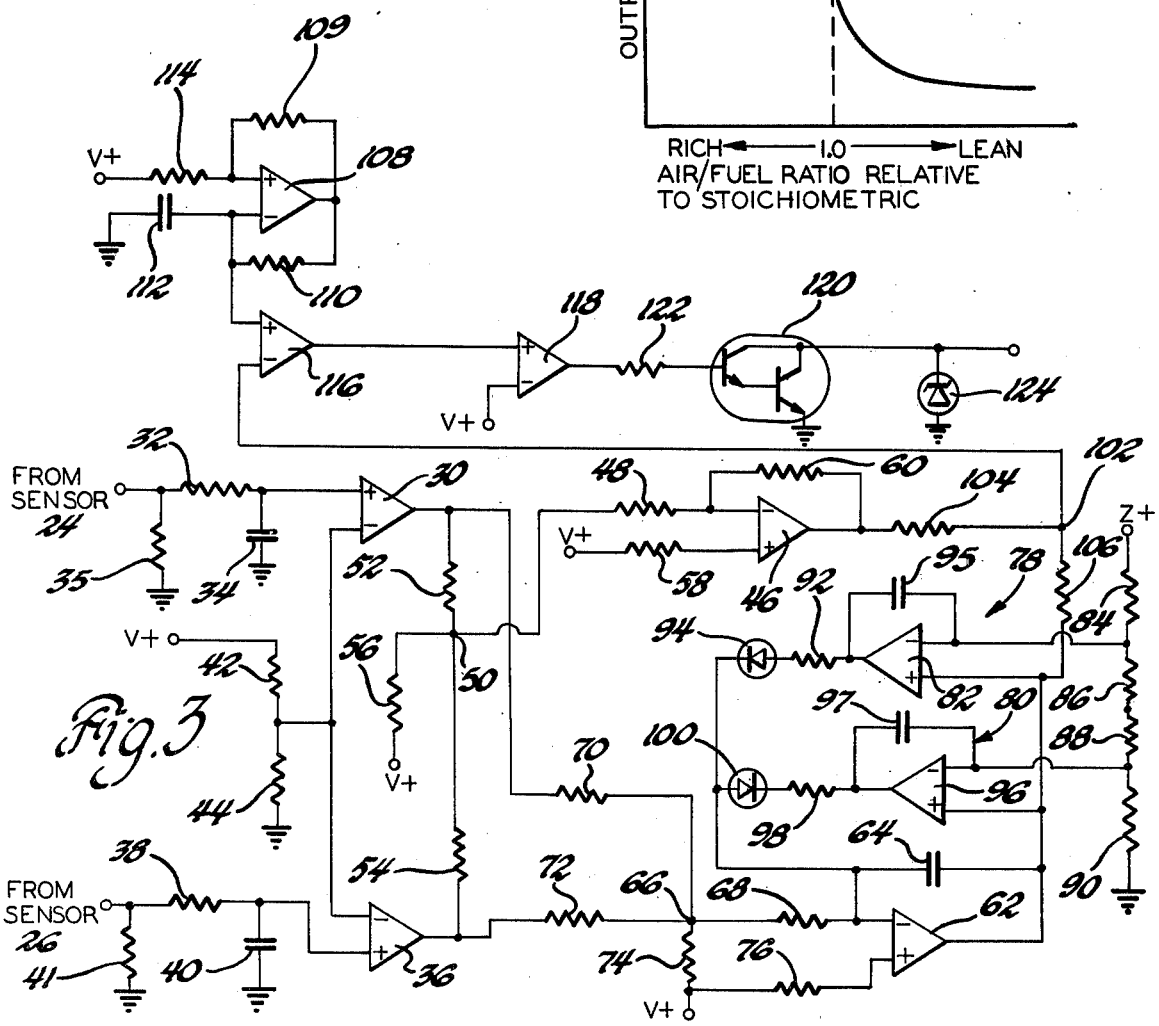
FIG. 3 is a circuit diagram of the control circuit of FIG. 1 incorporating the principles of this invention.

Referring to FIG. 3, a schematic diagram of the control circuit 28 which responds to the output of the oxygen sensors 24 and 26 to adjust the air/fuel ratio of the mixture supplied to the carburetor 16 in accordance with the principles of the present invention is illustrated.

The output of the oxygen sensor 24 monitoring the exhaust gas output of the exhaust manifold 12 is coupled to the input of a comparator switch 30 through a filter comprised of a filtering resistor 32 and a filtering capacitor 34. The filter functions to filter high frequency noise induced in the system from, for example, the engine ignition system. A pull-down resistor 35 is coupled between the sensor 24 output and ground. The leakage current through the resistor 35 from the switch 30 during the period of sensor warmup provides a simulated lean sensor signal to the switch 30.

The output of the oxygen sensor 26 is coupled to the positive input of a comparator switch 36 through a high frequency filter comprised of a filtering resistor 38 and a filtering capacitor 40. This filter functions in the same manner as the filter associated with the comparator switch 30 to filter high frequency noise. A pull-down resistor 41 is coupled between the sensor 26 output and ground and functions in the same manner as resistor 35 to provide a simulated lean sensor signal to the switch 36 during its warmup period.

A reference voltage is provided to the negative inputs of the comparator switches 30 and 36 by means of a voltage divider comprised of a resistor 42 and a resistor 44 coupled between a voltage source V+ and ground. The reference voltage output between resistors 42 and 44 has a value equal to the output voltage of the oxygen sensors 24 and 26 when the air/fuel ratios sensed thereby is at stoichiometry. This reference value is illustrated in FIG. 2 and comprises a voltage level between the upper and lower levels of the outputs of the oxygen sensors 24 and 26. Each of the comparator switches 30 and 36 provides an output signal which shifts abruptly between a constant low voltage level when the output of the oxygen sensor associated therewith represents an air/fuel ratio greater than stoichiometry and a constant high voltage level when the output represents an air/fuel ratio less than stoichiometry.

When the air/fuel ratios of the mixtures supplied to the left and right cylinder banks of the engine 10 differ, the output levels or states from the comparator switches 30 and 36 may assume one of three possible combinations. When each of the sensed air/fuel ratios is less than stoichiometry, the output of each of the comparator switches 30 and 36 is at the high voltage level. When each of the sensed air/fuel ratios is greater than stoichiometry, the outputs of each of the comparator switches 30 and 36 is at the low voltage level. However, when one of the oxygen sensors 24 or 26 senses an air/fuel ratio greater than stoichiometry and the remaining one sneses an air/fuel ratio less than stoichiometry, the output of one of the comparator switches 30 and 36 will be at the low voltage level while the output level of the remaining one will be at the high voltage level.

An integral plus proportional correction term in the form of a step plus ramp is generated in response to predetermined combinations of the output levels of the comparator switches 30 and 36 which is effective to control the average of the air/fuel ratios supplied to each of the cylinder banks of the engine 10 to stoichiometry.

The proportional term is provided by an amplifier 46 and its associated circuitry. A signal related to the combination of the output states of the comparator switches 30 and 36 is provided to the negative input of the amplifier 46 through a resistor 48. This signal is provided from a summing junction 50 which receives an input from the output of the comparator switch 30 through a resistor 52, an input from the output of the comparator switch 36 through a resistor 54 and an input from the voltage V+ through a resistor 56. The voltage value V+ is intermediate the upper and lower voltage levels from the comparator switches 30 and 36. The respective voltage and resistor values are such that the voltage signal supplied to the negative input of the amplifier 46 has a value that is greater than the voltage value V+ when the output of each of the comparator switches 30 and 36 is at the positive voltage level representing a sensed rich air/fuel mixture by both of the sensors 24 and 26, a value that is less than the voltage value V+ when the output of each of the comparator switches 30 and 36 is at the low voltage value representing a sensed lean air/fuel ratio by both of the sensors 24 and 26, and a value that is equal to the value V+ when the output of one of the comparator switches 30 and 36 is at the high voltage level and the remaining one is at the low voltage level representing a sensed rich air/fuel ratio by one of the sensors 24 and 26 and a sensed lean air/fuel ratio by the other sensor.

The voltage at the summing junction 50 is compared to the voltage value V+ which is coupled to the positive input of the amplifier 46 through a resistor 58. A gain setting resistor 60 is coupled between the negative input and the output of the amplifier 46. The output of the amplifier 46 representing the proportional term has a negative value when the outputs of both of the comparator switches 30 and 36 are at the high voltage level representing a sensed rich air/fuel ratio by each of the sensors 24 and 26, a positive voltage level when the outputs of both of the comparator switches 30 and 36 is at the low voltage level representing a sensed leaned air/fuel ratio by each of the sensors 24 and 26 and an intermediate value when one of the outputs of the comparator switches 30 and 36 is at the low voltage level and the output of the remaining one is at the high voltage level representing a sensed lean air/fuel ratio by one of the sensors 24 and 26 and a sensed rich air/fuel ratio by the other sensor.

The integral correction term is provided by an integrator, which is comprised of an operational amplifier 62 having a feedback capacitor 64 coupled between its output and its negative input, and its associated circuitry.

A signal related to the combination of the output levels of the comparator switches 30 and 36 is coupled to the negative input of the amplifier 62 from a summing junction 66 through a resistor 68. The summing junction 66 receives one input from the output of the comparator switch 30 through a resistor 70, an input from the output of the comparator switch 36 through a resistor 72 and an input from the voltage V+ through a resistor 74. The junction 66 voltage has a value greater than the voltage value V+ when the outputs of each of the comparator switches 30 and 36 are at the high voltage level representing a sensed rich air/fuel ratio by both of the sensors 24 and 26, a value less than the voltage value V+ when the outputs of each of the comparator switches 30 and 36 are at the low voltage level representing a sensed lean air/fuel ratio by both of the sensors 24 and 26, and a value equal to the voltage V+ when one of the outputs of the comparator switches 30 and 36 is at the low voltage level and the output of the remaining comparator switch is at the high voltage level representing a sensed rich air/fuel ratio by one of the sensors 24 and 26 and a sensed lean air/fuel ratio by the remaining sensor. The voltage V+ is coupled to the positive input of the amplifier 62 through a resistor 76.

When both of the sensors 24 and 26 sense a rich air/fuel ratio, the integral term output of the amplifier 62 decreases at a constant rate determined by circuit values and the difference between the voltage at the junction 66 and the voltage V+. When both of the sensors 24 and 26 sense a lean air/fuel ratio, the integral term at the output of the amplifier 62 increases at a constant rate determined by the difference in the voltage values at the junction 66 and the value V+. In the preferred embodiment, the rates of the integral term in each direction are equal.

When one of the sensors 24 or 26 senses a lean air/fuel ratio and the remaining sensor senses a rich air/fuel ratio, the circuit values are such that the voltage value at the summing junction 66 equals the voltage value V+ and the integral term output of the amplifier 62 remains constant. Therefore, the integral term output of the amplifier 62 varies in a positive or negative direction with a constant slope when both of the sensors 24 and 26 sense either a rich air/fuel ratio or a lean air/fuel ratio and remains constant when the sensed air/fuel ratios differ in an opposite sense relative to stoichiometry.

The limits of the integral term output of the amplifier 62 are set by a limiting circuit 78 which limits the maximum value of the integral term and a limiting circuit 80 which limits the minimum value of the integral control term.

The limiting circuit 78 includes an amplifier 82 which receives the integral term output of the amplifier 62 at its positive input and a reference level equal to the upper limit of the integral term from a reference circuit comprised of series coupled resistors 84, 86, 88 and 90 coupled between a voltage Z+ and ground. The values of the resistors 84 through 90 are selected so that the reference voltage supplied to the negative input of the amplifier 78 from between the resistors 84 and 86 represents the maximum desired value of the integral control term. The output of the amplifier 78 is coupled to the negative input of the amplifier 62 through a resistor 92 and a diode 94. A capacitor 95 is coupled between the negative input of the amplifier 82 and its output so as to form an integrator having a relatively short time constant.

When the outputs of each of the comparator switches 30 and 36 are at the low voltage levels representing a sensed lean air/fuel ratio by each of the sensors 24 and 26, the integral term output of the amplifier 62 increases at a constant rate. If the integral term attains a magnitude greater than the reference value supplied to the negative input of the amplifier 78, the output of the amplifier 78 increases in the positive direction to supply current to the negative input of the amplifier 62 until an equilibrium is reached at which the inputs to the amplifier 62 are equal and the output thereof remains constant at the value of the reference voltage between the resistors 84 and 86.

The limiting circuit 80 similarly functions to limit the lower value of the integral control term. In this respect, the limiting circuit 80 includes an amplifier 96 having feedback capacitor 97 which receives the integral control term output of the amplifier 62 at a positive input and a reference voltage at its negative input from between resistors 88 and 90. This reference voltage is equal to the lower limit of the integral term. The output of the amplifier 96 is coupled to the negative input of the amplifier 62 through a resistor 98 and a diode 100. When the outputs of both of the comparator switches 30, 36 are at the positive voltage level representing a rich air/fuel ratio sensed by each of the sensors 24 and 26, the integral control term output of the amplifier 62 decreases at a constant rate. If the integral control term decreases to the value of the reference voltage at the junction between the resistors 88 and 90, the output of the amplifier 96 decreases to conduct current from the negative input of the amplifier 62. An equilibrium is reached at which the inputs to the amplifier 62 are equal and its output is equal to the reference voltage provided to the amplifier 96.

The proportional and integral correction terms at the output of the amplifiers 46 and 62, respectively, are summed at a summing junction 102 through a resistor 104 and a resistor 106. This net correction term is coupled to a voltage controlled duty cycle oscillator which provides control pulses at a constant frequency but variable width to the air/fuel ratio adjustment device in the carburetor 16. In general, the duty cycle output of the duty cycle oscillator may, for illustrative purposes, vary between 5% and 95%, as limited by the limiting circuits 78 and 80, an increasingly duty cycle effecting a decreasing fuel flow so as to increase the air/fuel ratio and a decreasing duty cycle effecting an increase in the fuel flow so as to decrease the air/fuel ratio. The range of duty cycle from 5% to 95% may, for example, represent a change in three air/fuel ratios at the carburetor 16.

The voltage controlled duty cycle oscillator is generally comprised of a triangular wave generator formed by an amplifier 108 having feedback resistors 109 and 110. A capacitor 112 is coupled between the negative input and ground and a resistor 114 is coupled between the voltage V+ and the positive terminal. The triangular wave output is provided at the negative input terminal of the amplifier 108 and is coupled to the positive input of a comparator switch 116. The proportional plus integral control signal from the summing junction 102 is coupled to the negative input of the comparator switch 16. The range of values of the correction term provided to the negative input of the amplifier 116 is intermediate the upper and lower voltage levels of the triangular wave form so that the output of the comparator switch 116 is a duty cycle signal having a duty cycle inversely proportional to the magnitude of the proportional plus integral term at the summing junction 102. The authority of the integral plus proportional terms are limited as previously indicated during normal operations so as to provide the above mentioned range of duty cycles. The output of the comparator switch 116 is coupled to the positive input of a switching amplifier 118 whose output is coupled to the base of a Darlington NPN transistor 120 through a resistor 122. The voltage V+ is coupled to the negative input of the switching amplifier 118. The emitter of the Darlington transistor 120 is grounded and the collector thereof is coupled across a zener diode 124. The output of the voltage controlled duty cycle oscillator is provided at the collector of the Darlington transistor 120. This duty cycle modulated signal is coupled to the controller at the carburetor 16 which functions to increase the fuel flow rate into the engine 10 with decreasing duty cycle and decreases the fuel flow rate in response to increasing duty cycle.

When the air/fuel ratio sensed by each of the oxygen sensors 24 and 26 both become less than stoichiometry, the proportional term steps to its negative value and the integral control term decreases at a constant rate to thereby increase the duty cycle of the output of the duty cycle oscillator in a step plus ramp fashion to decrease the fuel flow rate and consequently the air/fuel ratio of the mixture supplied to each of the cylinder banks of the engine 10. Conversely, when both of the oxygen sensors sense an air/fuel ratio greater than stoichiometry, the proportional term steps to its positive value and the integral control term increases at a constant rate to decrease the duty cycle output of the duty cycle oscillator in a step plus ramp fashion which increases the fuel flow rate to thereby increase the air/fuel ratio of the mixture supplied to each of the cylinder banks of the engine 10. When the air/fuel ratios sensed by the sensors 24 and 26 differ in an opposite sense from stoichiometry, the proportional term shifts to its intermediate value and the integral control term remains a constant value. The duty cycle output of the duty cycle oscillator shifts in a direction determined by the direction of the proportional term shift after which the duty cycle remains constant. The duty cycle output from the Darlington transistor 120 may be inverted if the controller at the carburetor 16 is of the type that increases the air/fuel ratio with increasing duty cycle and decreases the ratio with decreasing duty cycle.

While the control system at the carburetor 16 for modifying the air/fuel ratio of the mixture supplied to each bank of the engine 10 may take any of the well known forms, it may assume the form as illustrated in the U.S. application Ser. No. 801,061 filed on May 27, 1977, which illustrates a carburetor in which the air/fuel ratio is controlled as a function of a duty cycle modulated signal. This signal energizes a solenoid valve that couples a control vacuum signal from a regulated vacuum source in accordance with the duty cycle of a signal. The control vacuum functions to position a metering rod to adjust the fuel flow.

Due to the transport delay between the supplying of an air/fuel mixture to the engine 10 and the sensing of the resulting air/fuel ratio by the respective oxygen sensors 24 and 26, the proportional plus integral control term causes the air/fuel ratio in the carburetor to overshoot the stoichiometric air/fuel ratio by an amount determined by the transport delay, the value of the proportional step function and the rate of change of the integral term of the control signal. Consequently, the system will generally oscillate with the amplitude and frequency of the oscillation being determined by the time constants of the control system and the transport delay. However, during each direction of the oscillation, the system output dwells at a constant air/fuel ratio for a time determined by the difference between the air/fuel ratios of the mixture supplied to each bank of the engine 10. The resulting average of the air/fuel ratio of the mixtures supplied to the cylinder banks of the engine 10 is equal to the stoichiometric air/fuel ratio represented by the switch point of the comparator switches 30 and 36.

In the foregoing manner, the air/fuel ratio of the mixture supplied to the engine 10 is maintained at an average stoichiometric air/fuel ratio even though the air/fuel ratio of the mixtures supplied to each cylinder bank differ while yet retaining the benefits of locating the sensors in close proximity to the exhaust discharge of the manifolds 12 and 14.

While the preferred embodiment is illustrated with respect to the response of the control system to a specific combination of the outputs of the comparator switches 30 and 36, it is understood that a control system may respond to other combinations of the comparative switches 30 and 36 to achieve desired control. For example, the control system may respond to cause a decrease in the air/fuel ratio only when both of the comparative switches 30 and 36 are at the low voltage level representing a sensed lean air/fuel ratio and cause the system to increase the air/fuel ratio when one of the comparator switches 30 and 36 is at the high voltage level representing one of the sensors 24 and 26 sensing a rich air/fuel ratio.

The preferred embodiment of the invention for the purpose of illustrating the principles thereof is not to be considered to be as limiting or restricting the invention, since many modifications may be made by the exercise of skill in the art without departing from the scope of the invention.

The embodiments of the invention in which an exclusive property or privilege is claimed are defined as follows:

1. A closed loop control system for controlling the ratio of the air/fuel mixture supplied to an internal combustion engine having two cylinder banks and separate exhaust gas manifolds for each cylinder bank, the system comprising:

air/fuel mixture delivery means, the delivery means being effective to supply an air/fuel mixture to each of the cylinder banks, the air/fuel ratios of the mixtures supplied to the cylinder banks having relative values determined by the characteristics of the engine and the delivery means;

means responsive to the content of the exhaust gas output of each of the exhaust gas manifolds effective to generate respective first and second air/fuel ratio signals each being switched between first and second voltage values in accord with the relationship of a sensed air/fuel ratio relative to a predetermined ratio;

means effective to generate a control signal having a value progressively increasing in response to a first combination of the voltage values of the first and second air/fuel ratio signals and having a value progressively decreasing in response to a second combination of the voltage values of the first and second air/fuel ratio signals; and control means effective to control each of the air/fuel mixture delivery means in accord with the instantaneous value of the control signal.

2. A closed loop control system for controlling the ratio of the air/fuel mixture supplied to an internal combustion engine having two cylinder banks and separate exhaust gas manifolds for each cylinder bank, the system comprising:

air/fuel mixture delivery means, the delivery means being effective to supply an air/fuel mixture to each of the cylinder banks, the air/fuel ratios of the mixtures supplied to the cylinder banks having relative values determined by the characteristics of the engine and the delivery means;

means responsive to the content of the exhaust gas output of each of the exhaust gas manifolds effective to generate respective first and second air/fuel ratio signals each changing abruptly between first and second voltage values in accord with the relationship of a sensed air/fuel ratio relative to a predetermined ratio;

means responsive to the first and second air/fuel ratio signals effective to generate a control signal having (A) a value progressively increasing when the air/fuel ratio signals are both at the first voltage value, (B) a value progressively decreasing when the air/fuel ratio signals are both at the second voltage value and (C) a value held constant when the air/fuel ratio signals are at different voltage values; and control means effective to control each of the air/fuel mixture delivery means in accord with the instantaneous value of the control signal, the mean value between the air/fuel ratios of the mixtures supplied to the cylinder banks being equal to the predetermined ratio.

3. A closed loop control system for controlling the ratio of the air/fuel mixture supplied to an internal combustion engine having two cylinder banks and separate exhaust gas manifolds for each cylinder bank, the system comprising:

first and second air/fuel mixture delivery means, each of said delivery means being effective to supply an air/fuel mixture to a respective one of the cylinder banks, the air/fuel ratios of the mixtures supplied to the cylinder banks having relative values determined by the characteristics of the first and second delivery means;

means responsive to the content of the exhaust gas output of each of the exhaust gas manifolds effective to generate respective first and second air/fuel ratio signals each being switched between first and second voltage values in accord with the relationship of a sensed air/fuel ratio relative to a predetermined ratio;

means responsive to the first and second air/fuel ratio signals effective to generate a control signal having (A) a value progressively increasing when the air/fuel ratio signals are both at the first voltage value, (B) a value progressively decreasing when the air/fuel ratio signals are both at the second voltage value and (C) a value held constant when the air/fuel ratio signals are at different voltage values; and control means effective to control each of the air/fuel mixture delivery means in accord with the instantaneous value of the control signal, the mean value between the air/fuel ratios of the mixtures supplied to the cylinder banks being equal to the predetermined ratio.

* * * * *